United States Patent [19]

Narasimhan et al.

[11] Patent Number: 4,585,473

[45] Date of Patent: Apr. 29, 1986

[54] METHOD FOR MAKING RARE-EARTH ELEMENT CONTAINING PERMANENT MAGNETS

[75] Inventors: Kalatur S. V. L. Narasimhan, Monroeville; Edward J. Dulis, Pittsburgh, both of Pa.

[73] Assignee: Crucible Materials Corporation, Pittsburgh, Pa.

[21] Appl. No.: 598,118

[22] Filed: Apr. 9, 1984

[51] Int. Cl.[4] ..... C22C 1/04

[52] U.S. Cl. ..... 75/0.5 C; 75/246; 264/12; 148/101; 148/104

[58] Field of Search ..... 148/101, 102, 103, 104, 148/105; 75/0.5 C, 246; 264/12

[56] References Cited

U.S. PATENT DOCUMENTS

| | | | |
|---|---|---|---|
| 1,671,683 | 5/1928 | Podszus | 75/0.5 C |
| 2,384,892 | 9/1945 | Comstock | 75/0.5 C |
| 3,424,578 | 1/1969 | Strnat et al. | 148/105 |
| 3,560,200 | 2/1971 | Nesbitt et al. | 148/101 |
| 3,646,177 | 2/1972 | Thompson et al. | 264/12 |
| 3,671,230 | 6/1972 | Smythe et al. | 75/0.5 C |
| 3,901,741 | 8/1975 | Benz et al. | 148/103 |
| 4,152,178 | 5/1979 | Malekzadch et al. | 148/103 |
| 4,369,075 | 1/1983 | Nbuo et al. | 148/102 |

FOREIGN PATENT DOCUMENTS

| | | |
|---|---|---|
| 101552 | 2/1984 | European Pat. Off. . |
| 57-141901 | 9/1982 | Japan . |

OTHER PUBLICATIONS

Chaban et al, "Ternary (Nd, Sm, Gd)-Fe-B Systems", Dopov. Akad. Nack., URSR, Ser. A: Fiz.-Mat. Tekh. Nack., 10, pp. 873-879 (1979).

*Primary Examiner*—John P. Sheehan

*Attorney, Agent, or Firm*—Finnegan, Henderson, Farabow, Garrett & Dunner

[57] ABSTRACT

A method for making rare earth-permanent magnets wherein a molten mass of a rare earth magnet alloy is produced such as by induction melting and while in a protective atmosphere is introduced in the form of a stream into a chamber having a protective atmosphere and a bottom portion containing a cooling medium, such as a cryogenic liquid which may be liquid argon. After cooling and solidification, the alloy is collected from the chamber and comminuted to produce particles. The particles are formed into a magnet body. Alternately, the stream may be atomized, as by striking the same with a jet of inert gas, to produce discrete droplets, which droplets are directed to the cooling medium at the chamber bottom for cooling, solidification and collection.

18 Claims, 3 Drawing Figures

METHOD FOR MAKING RARE-EARTH ELEMENT CONTAINING PERMANENT MAGNETS

It is known to produce permanent magnets containing at least one rare earth element as a significant alloying constituent, which elements may be for example samarium, praseodymium, neodymium, lanthanum, cerium, yttrium, or mischmetal. These magnets are conventionally produced by the vacuum induction melting of a prealloyed charge to produce a molten mass of the desired magnet alloy composition. The molten mass is poured into an ingot mold for solidification. The solidified ingot is then comminuted to form fine particles on the order of 2 to 5 microns by an initial crushing operation followed by ball milling or jet milling to final particle size. The particles so produced are formed into the desired magnet body either by cold pressing followed by sintering or by the use of a plastic binder or other low-melting point material suitable for use as a binder within which the magnetic particles are embedded to form the magnet body.

Because of the relatively low solidification rate of the ingot from which the particles are made, the ingot and thus the particles are not uniform as a result of ingot segregation during cooling. Also, during the comminuting operation the small particles are subjected to surface oxidation. In addition, during the comminuting operation the mechanical working incident thereto introduces stresses and strain in the resulting particles, as well as defects in the particles introduced by the grinding medium. All of these factors in the conventional practice of making rare earth permanent magnets contribute to nonhomogeneity with respect to the composition of the resulting magnet body as well as nonuniformity thereof. This in turn adversely affects the magnetic properties.

It is accordingly a primary object of the present invention to provide a method for manufacturing rare earth permanent magnets wherein a magnet body may be produced that is characterized by excellent compositional homogeneity and absence of defects and impurities.

A more specific object of the present invention is to provide a method for manufacturing particles from which a permanent magnet body may be manufactured, which particles are substantially compositionally uniform, homogeneous and lacking in impurities and defects.

These and other objects of the invention, as well as a more complete understanding thereof, may be obtained from the following description and drawings, in which.

Figure 1:
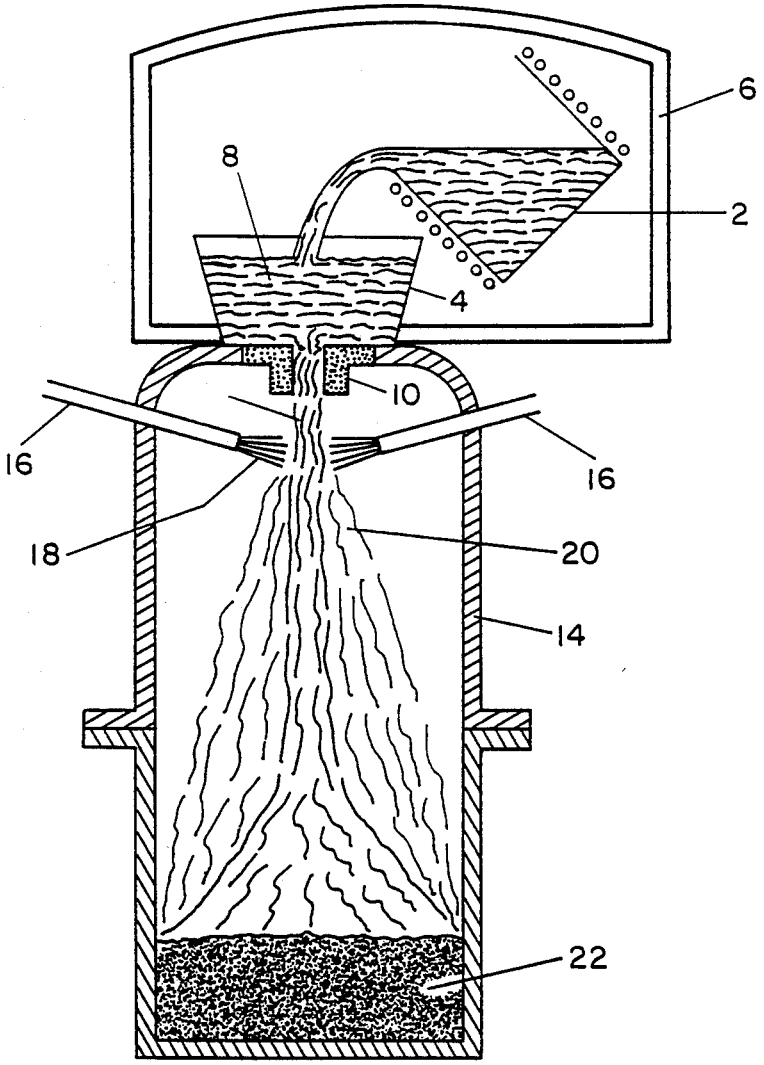
FIG. 1 is a schematic showing of one embodiment of apparatus suitable for use with the method of the invention.

Broadly, in accordance with the practice of the present invention, the method comprises producing a molten mass of the desired rare earth magnet alloy, such as by induction melting in the well known manner, and while maintaining the molten mass in a protective atmosphere a stream thereof is introduced into a chamber, also having a protective atmosphere, and with a bottom portion containing a cryogenic liquid, such as liquid argon. The stream is permitted to strike the cryogenic liquid or a bottom plate cooled by the cryogenic liquid or other suitable cooling medium whereupon the stream is cooled to form a solidified mass. The solidified mass is removed from the chamber, comminuted in the conventional manner to form fine particles which particles are suitable for the production of magnet bodies. Because of the rapid solidification of the molten mass of rare earth magnet alloy it is of relatively uniform composition throughout, which uniformity is maintained in the particles producing therefrom. Consequently, the particles are characterized by a uniform and homogeneous microstructure, which serves to enhance the magnetic properties of magnets produced therefrom. This is in contrast to the comminuting of a conventional ingot casting subjected to relatively slow cooling rates and thus segregation throughout the solidified ingot. The particles produced are typically within the size range of 1 to 5 microns.

An alternate practice, in accordance with the invention, involves striking the stream from the molten alloy mass as it enters the chamber with an atomizing medium, such as argon gas, to form droplets, which droplets are cooled, solidified and collected in either said cryogenic liquid or alternately a bottom plate cooled by said cryogenic liquid or other suitable cooling medium. Thereafter, the resulting particles are removed from the chamber and used to form a magnet body either directly or after comminuting to further reduce the particle size. The stream may be atomized by the use of a jet of an inert fluid such as argon gas.

Although the method of the invention has utility generally with rare earth permanent magnet alloys, as will be shown in detail hereinafter, it has particular utility with a rare earth magnet alloy within the composition limits, in weight percent, 35 to 38 neodymium, 60 to 64.8 iron and 0.2 to 2 boron. The neodymium referred to in the specification and claims hereof with respect to this alloy has reference to "effective neodymium". Effective neodymium is the total neodymium minus that portion thereof that reacts with the oxygen present to form $Nd_2O_3$. This amount of neodymium is determined as follows:

$$\%ND(effective) = \%Nd(total) - 6 \times \%O_2$$

For example, a 35% neodymium-containing alloy having 0.121% oxygen has an effective neodymium of 34.28%.

With the practice of the invention in producing rare earth magnets and powders for use in the manufacture thereof and specifically with regard to the specific alloy compositions set forth above, drastically improved magnetic properties, particularly induction and coercive force, are produced. Coercive force is improved with homogeneity of the grains of the particles from which the magnet is made from the standpoint of both metallurgical composition and absence of defects. The finer the particles the less will be the compositional variation within the grains thereof. Since the particles produced in accordance with the practice of the invention are of improved homogeneity over particles resulting from conventional practices this compositional homogeneity within the grains is maximized by the invention. Improved induction results from fine particle sizes with correspondingly reduced crystals within each particle. This permits maximum orientation to in turn maximize induction. In accordance with the practice of the invention, as will be demonstrated hereinafter, it is possible to achieve these desired very fine particles for purposes of improving induction without the attendant disadvantages of increased stress and strain as a result of the great amount of mechanical work during comminution and without increasing defects as a result thereof.

In accordance with the method of the invention, FIG. 1 is a schematic showing of one embodiment of apparatus for use therewith. As shown in FIG. 1 molten alloy is poured from a tiltable furnace 2 to a tundish 4. The tundish and furnace are in an enclosure 6 providing a protective atmosphere. The molten alloy, designated as 8, is of a prealloyed rare earth permanent magnet alloy. In the bottom of the tundish 4 there is a nozzle 10 through which the metal from the tundish in the form of a stream 12 enters a chamber 14 having a protective atmosphere therein. The stream 12 may be atomized by jets 16 which direct streams of atomizing gas 18 onto the stream 12 to atomize the same into droplets 20. The droplets fall to the bottom of the chamber and are cooled in cryogenic liquid 22 for subsequent solidification and removal. In accordance with the alternate embodiment of the invention the stream 12 would not be atomized but instead would be introduced directly to the cryogenic liquid for cooling, solidification and collection. Upon removal from the chamber 14, the solidified alloy would be comminuted to the desired particle size.

In accordance with the invention the solidification rate of the atomized particles would be on the order of 1000° C. per second to 1,000,000° C. per second depending upon the particle size distribution. This extremely rapid solidification rate prevents any variation in the structure of the particles resulting from cooling.

The invention as described is beneficial for use with rare earth magnet alloys in general which alloys would contain for example 20 to 40% of at least one rare earth element which would include samarium, neodymium, praseodymium, lanthanum, cerium, yttrium and mischmetal. The remainder of the alloy would be at least one element from the group cobalt, iron or a transition metal such as nickel or copper. Boron up to about 2% by weight as well as aluminum up to about 10% by weight could also be included.

By way of a specific example to demonstrate the homogeneity of the particles produced in accordance with the practice of the invention, as compared with conventional vacuum induction melted, ingot cast and ground particles, a vacuum induction melt of the following composition, in weight percent, was produced:

Neodymium: 32.58
Iron: 66.44
Boron: 0.98

This alloy was conventionally ingot cast and ground to the particle sizes set forth in Table I and was also, in accordance with the practice of the invention, atomized by the use of an argon gas jet and quenched in liquid argon.

TABLE I

| Powder Size and Method of Preparation, Microns ($\mu$) | Phases Present, % | |
|---|---|---|
| | $Nd_{15}Fe_{80}B_5$ | $Fe_2B$ |
| VIM, Argon Gas Atomized, and Liquid Argon Quenched | | |
| −590 | 100 | 0 |
| −250 | 100 | 0 |
| −37 | 100 | 0 |
| VIM, Ingot Cast, and Ground | | |
| −590 | 83 | 17 |
| −250 | 82 | 18 |
| −74 | 84 | 16 |
| −37 | 86.2 | 13.8 |

VIM = Vacuum Induction Melted

The as-quenched particles were screened to the size fractions set forth in Table I and tested by Curie temperature measurements to determine the metallurgical phases thereof. As may be seen from Table I, in the conventionally ingot cast alloy two phases were present in each instance, namely the tetragonal $Nd_{15}Fe_{80}B_5$ and the $Fe_2B$ phases. For the particles produced in accordance with the invention only the former phase was present indicating complete homogeneity.

To demonstrate the alternate practice of the invention wherein the stream of the rare earth magnet alloy is introduced directly to the cryogenic liquid or liquid cooled plate for cooling and solidification, without atomization, various rare earth magnet alloys of the compositions $MnCo_5$, $SmCo_5$, Nd, Fe, B and $Sm_2Co_{17}$ were vacuum induction melted, solidified at various rates characteristic of the method used. Oxygen measurements were made using standard chemical analysis. These are reported in Table II.

In accordance with the practice of the invention a stream of the alloy was introduced to a chamber having liquid argon in the bottom thereof which served to rapidly cool the molten alloy stream. During subsequent comminution it was determined that this material was more amenable to the formation of desired fine particles than conventional cast material of the same alloy composition. This is demonstrated by the data set forth in Table II wherein the oxygen content of the conventional powder was significantly higher than comparable size powder produced both by liquid argon quenching of atomized molten alloy and molten alloy introduced directly without atomization to the liquid argon for cooling and solidification, both of which practices are in accordance with the invention.

TABLE II

| Method of Preparing Rare Earth/ Metal Powder | Oxygen Content ppm |
|---|---|
| Cast ingot, crushed and ground (conventional) | 2000–2800 |
| Argon gas atomized, liquid argon quench, ground (invention) | 130–180 |
| Direct liquid argon quench, ground (invention) | 110–150 |

Table III demonstrates the improvement in magnetic properties, namely induction ratios ($B_r/B_s$) and coercive force, for vacuum induction melted rare earth magnet alloy of the following composition produced both by conventional ingot casting and also in accordance with the invention by atomization and quenching in liquid argon. The composition of the alloy, in percent by weight, is as follows:

Neodymium: 32.58
Iron: 66.44
Boron: 0.98

It may be seen from Table III that with the particle size of less than 74 microns with the practice of the invention the coercive force is similar to the much finer 2.8 micron particle produced in accordance with conventional practice. Both the coercive force and induction ratio ($B_r/B_s$) values for rare earth magnet alloy particles show a drastic improvement at a particle size between 88 and 74 microns.

TABLE III

| Method of Production | Particle Sizes Microns, $\mu$ | $B_r/B_s$ | $H_{ci}$ Oe |
|---|---|---|---|
| VIM, atomized, liq. quenched | −74 | 0.38 | 1500 |
| VIM, atomized, liq. quenched | −88 | 0.17 | 525 |
| VIM, atomized, liq. quenched | −100 | 0.15 | 450 |
| VIM, atomized, liq. quenched | −250 | 0.12 | 400 |
| VIM, ingot cast, ground, jet milled | 2.8 | 0.61 | 1600 |

The data in Table IV demonstrates the improvement in coercive force achieved with the practice of the invention with a $SmCo_5$ alloy, as compared to this same alloy conventionally ingot cast and ground to form particles for use in producing a permanent magnet. In this test, with both the powder produced in accordance with the invention and the conventionally produced powder the powder was loaded into a die cavity and a magnetic field was applied to the powder to orient the same. The powder was then compressed during application of the magnetic field. The cold-pressed compact was then sintered at a temperature of 2050° F., followed by a heat treatment at 1750° F. for 3 hours.

TABLE IV

| Mesh Size Microns ($\mu$) | $H_{ci}$ (Oe) |
|---|---|
| Vacuum Melted, Atomized, and Inert Liquid Gas Quenched Particles | |
| −300 to +150 | 22,000 |
| −150 to +75 | 19,400 |
| Vacuum Melted, Ingot Cast, and Ground Powder | |
| −300 to +150 | 5,000 |
| −150 to +75 | 9,000 |

As may be seen from Table IV the coercive force values achieved in accordance with the practice of the invention for all size ranges of powder were drastically improved over the values achieved with the conventional practice. The atomized particles produced in accordance with the invention were divided into the reported size fractions by a screening operation and used to produce the magnet body without further grinding.

TABLE V

| | $H_{ci}$, $O_e$ |
|---|---|
| Vacuum melted, gas atomized, inert liquid gas quenched, and jet milled to 3 microns | 23,000 |
| Vacuum melted, ingot cast, ground and jet milled to 3 microns | 18,000 |

Table V reports magnets produced from this same powder as used in the test reported in Table IV with the powder being further comminuted to a 3-micron powder size by a conventional jet milling operation. This powder was compared to conventional ingot cast, ground and jet milled powder of the same 3-micron size. As may be seen from Table V there is a significant improvement in coercive force as demonstrated by the magnets produced by the powder manufactured in accordance with the invention.

TABLE VI

| | | $B_r$ (G) | $H_{ci}$ (Oe) | $BH_{max}$ MGOe |
|---|---|---|---|---|
| $SmCo_5$ | Vacuum melted, liquid argon quenched, crushed to 3 microns, pressed and sintered magnet | 8,650 | >25,000 | 18.5 |
| $SmCo_5$ | Vacuum melted, ingot cast, crushed to 3 microns, pressed and sintered | 8,700 | 16,000 | 18.0 |
| $MMCo_5$ | Vacuum melted, liquid argon quenched, crushed to 3 microns, pressed and sintered magnet | 7,950 | 19,000 | 15.0 |
| $MMCo_5$ | Vacuum melted, ingot cast, crushed to 3 microns, pressed and sintered | 7,200 | 13,300 | 13.0 |

Table VI reports a series of magnetic property tests conducted on magnets of the following compositions, in weight percent:

| Alloy 1 | Alloy 2 |
|---|---|
| Mischmetal 35 | Samarium 35 |
| Cobalt 65 | Cobalt 65 |

In these tests magnets were produced from both compositions wherein the particles of the alloy used to make the magnets were both liquid argon quenched in the absence of atomizing and then comminuted to a 3-micron particle size, and ingot cast and comminuted to a 3-micron particle size in accordance with conventional practice. In both instances the magnets produced from the particles were manufactured by the conventional practice of sintering at temperatures of 1900° to 2080° F. and heat treating at 1600° to 1800° F.

As may be seen from Table VI, there is a significant increase in coercive force and maximum energy product for magnets produced in accordance with the invention, as compared with the conventionally produced magnets. It is believed that this improvement in magnetic properties is related to the beneficial effect of the improved homogeneity and lower oxygen content of the powder produced in accordance with the invention, as compared to the conventionally produced powder.

It has been determined that if the practice of the invention is used with a rare earth magnet alloy composition in weight percent 35 to 38 neodymium, 60 to 64.8 iron and 0.2 to 2 boron, it is possible to achieve drastic improvement with regard to energy product ($BH_{max}$) on the order of 30,000,000 gauss oersteds minimum. To demonstrate this rare earth magnet alloys of the following compositions, in weight percent, were produced for testing:

| Total Nd % | Oxygen % | Effective Nd, % | $H_{ci}$ Oe | $BH_{max}$ Coe × $10^6$ |
|---|---|---|---|---|
| 35.0 | 0.121 | 34.28 | 3,700 | 23 |
| 37.0 | 0.15 | 36.1 | 12,000 | 31.5 |
| 34.9 | 0.126 | 34.22 | 3,350 | 24 |

-continued

| Total Nd % | Oxygen % | Effective Nd, % | $H_{ci}$ Oe | $BH_{max}$ Coe × $10^6$ |
|---|---|---|---|---|
| 36.8 | 0.124 | 36.08 | 11,650 | 30.3 |
| 34.2 | 0.120 | 33.4 | 3,250 | 17.0 |

These rare earth magnet alloy compositions were used to produce particles for the manufacture of permanent magnet bodies in accordance with the invention by argon gas atomization and liquid argon quenching.

Figure 2:
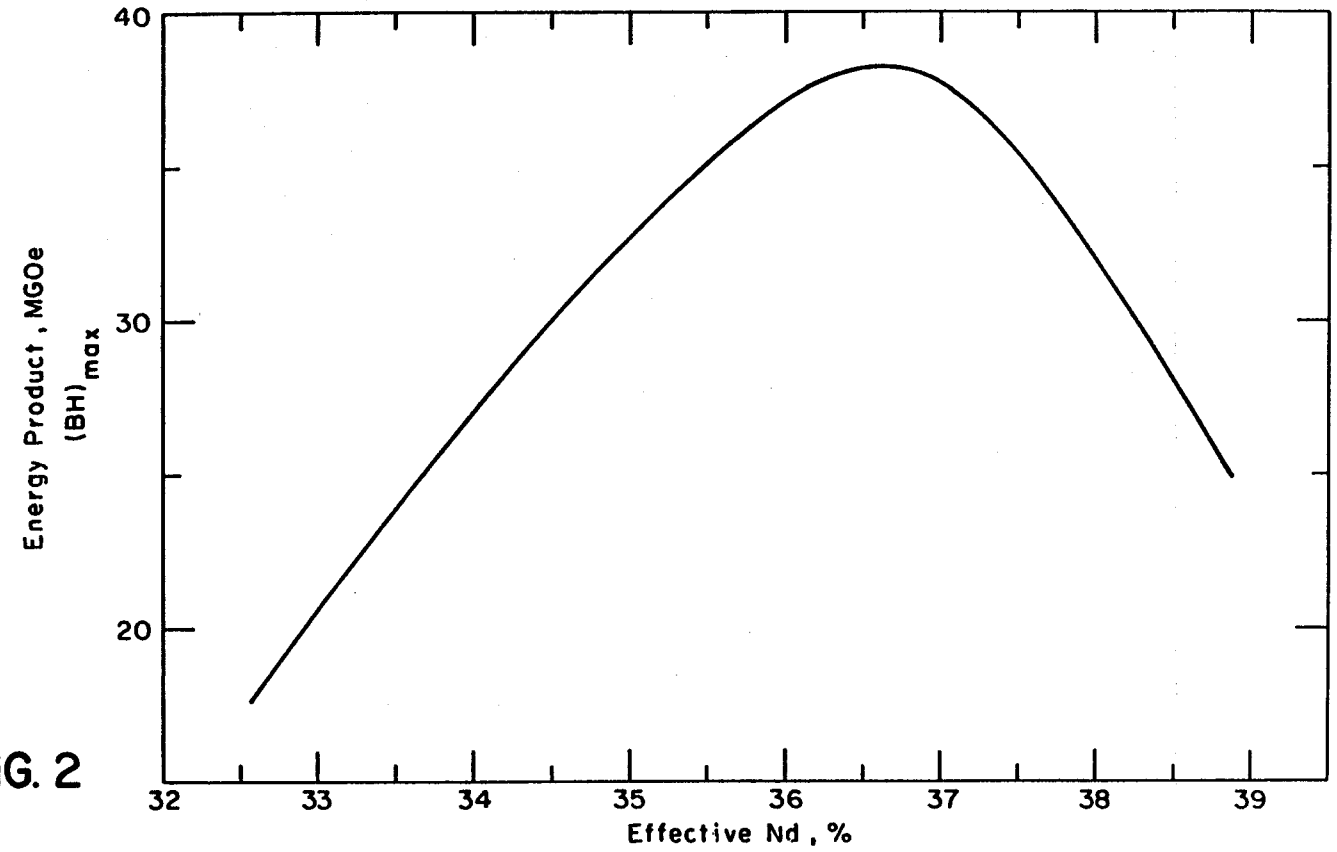
FIG. 2 is a graph relating to a preferred rare earth permanent magnet alloy composition with which the method of the invention finds particular utility and showing the energy product attainable by the use thereof.
Figure 3:
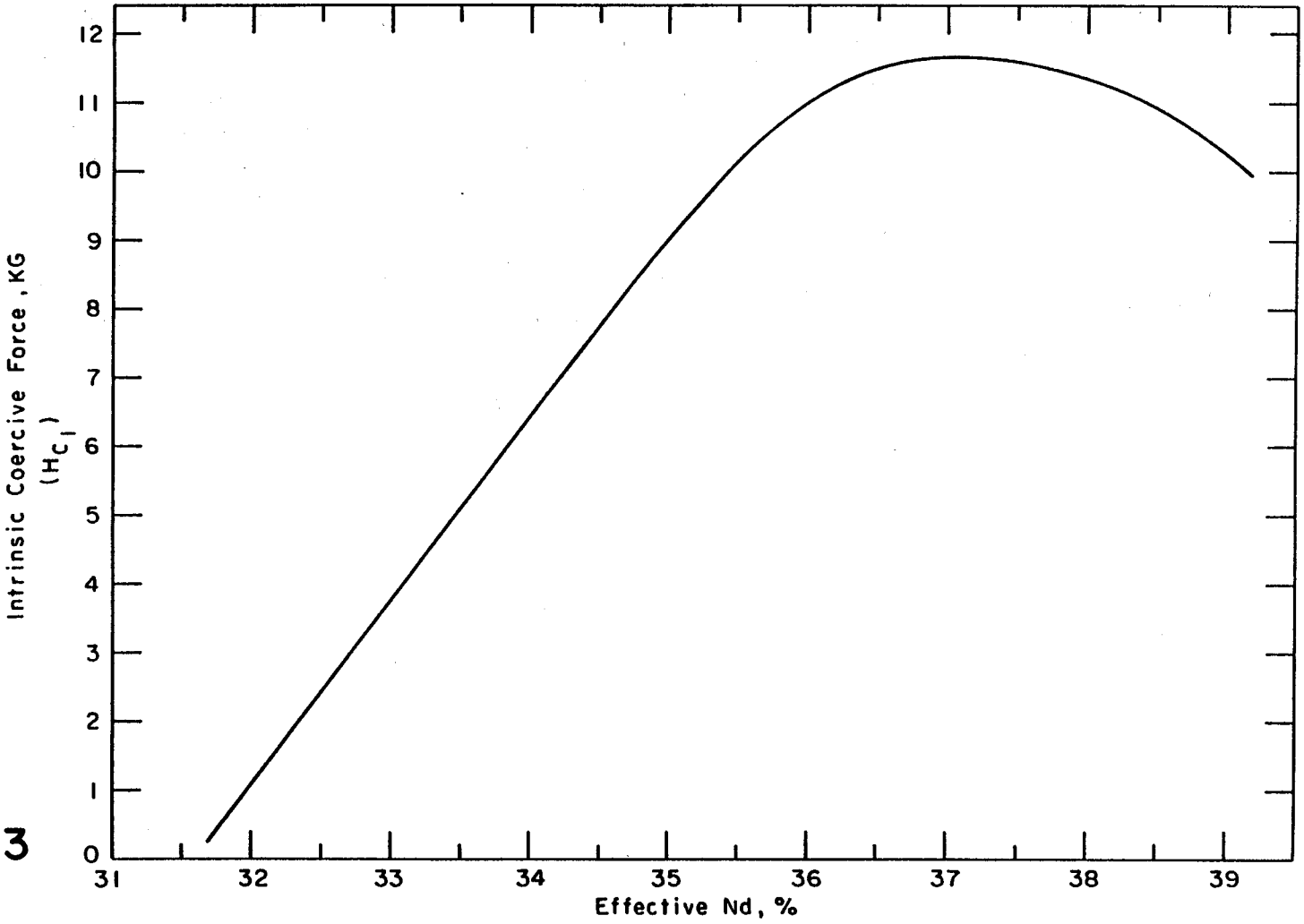
FIG. 3 is a graph similar to FIG. 2 for the same composition showing the coercive force obtainable by the use thereof in accordance with the practice of the invention.

As may be seen from FIG. 2 maximum energy product values are achieved within the neodymium range of approximately 35 to 38% by weight. Likewise, as may be seen in FIG. 3 optimum coercive force of 10,000 oersteds or greater is achieved within this same neodymium range. Consequently, the method of the invention finds particular utility with an alloy having neodymium within the range of 35 to 38%, iron within the range of 60 to 64.8% and boron within the range of 0.2 to 2%.

We claim:

1. A method for making rare-earth permanent magnets, said method comprising producing a molten mass of a rare-earth magnet alloy, maintaining said molten mass in a protective atmosphere while introducing said molten mass into a chamber having a protective atmosphere and a bottom portion containing a cryogenic liquid cooling medium, cooling and collecting said molten mass in said bottom portion to form a solidified mass, removing said solidified mass from said chamber, comminuting said solidified mass to produce particles and compacting said particles into a magnet body.

2. The method of claim 1 wherein said molten mass of said rare-earth magnet alloy is produced by vacuum induction melting.

3. The method of claim 1 wherein said cryogenic liquid is liquid argon and said chamber has an argon atmosphere.

4. The method of claim 1 wherein said particles are within the size range of 1 to 5 microns.

5. A method for making rare-earth permanent magnets, said method comprising producting a molten mass of a rare-earth magnet alloy, maintaining said molten mass in a protective atmosphere while introducing a stream of said molten mass into a chamber having a protective atmosphere and a bottom portion containing a cryogenic liquid cooling medium, atomizing said stream with an inert gas to form droplets, cooling and collecting said droplets in said bottom portion to produce particles, removing said particles from said chamber and compacting said particles into a magnet body.

6. The method of claim 5 wherein said inert gas is argon.

7. The method of claim 6 wherein said molten mass of said rare-earth magnet alloy is produced by vacuum induction melting.

8. The method of claim 5 wherein said cryogenic liquid is liquid argon and said chamber has an argon atmosphere.

9. The method of claim 8 wherein said particles are comminuted to produce finer particles within the size range of 1 to 5 microns.

10. A method for making rare-earth permanent magnets, said method comprising producing a molten mass of a rare-earth magnet alloy of the composition in weight percent 35 to 38 effective neodymium, 60 to 64.8 iron and 0.2 to 2 boron, maintaining said molten mass in a protective atmosphere while introducing said molten mass into a chamber having a protective atmosphere and a bottom portion containing a cryogenic liquid cooling medium, cooling and collecting said molten mass in said cooling medium to form a solidified mass, removing said solidified mass from said chamber, comminuting said solidified mass to produce particles and compacting said particles into a magnet body.

11. The method of claim 10 wherein said molten mass of said rare-earth magnet alloy is produced by vacuum induction melting.

12. The method of claim 10 wherein said cryogenic liquid is liquid argon and said chamber has an argon atmosphere.

13. The method of claim 10 wherein said particles are within the size range of 1 to 5 microns.

14. A method for making rare-earth permanent magnets, said method comprising producing a molten mass of a rare-earth magnet alloy of the composition in weight percent 35 to 38 effective neodymium, 60 to 64.8 iron and 0.2 to 2 boron, maintaining said molten mass in a protective atmosphere while introducing a stream of said molten mass into a chamber having a protective atmosphere and a bottom portion containing a cryogenic liquid cooling medium, atomizing said stream with an inert gas to form droplets, cooling and collecting said droplets in said cooling medium to produce particles, removing said particles from said chamber and compacting said particles into a magnet body.

15. The method of claim 14 wherein said inert gas is argon.

16. The method of claim 15 wherein said molten mass of said rare-earth magnet alloy is produced by vacuum induction melting.

17. The method of claim 16 wherein said cryogenic liquid is liquid argon and said chamber has an argon atmosphere.

18. The method of claim 17 wherein said particles are comminuted to produce finer particles within the size range of 1 to 5 microns.

* * * * *